US007308107B2

(12) United States Patent
Menzl et al.

(10) Patent No.: US 7,308,107 B2
(45) Date of Patent: Dec. 11, 2007

(54) METHOD FOR ACTIVATING A HEARING DEVICE

(75) Inventors: Stefan Daniel Menzl, Jona (CH); Ivo Hasler, Winterthur (CH)

(73) Assignee: Phonak AG, Stafa (CH)

( * ) Notice: Subject to any disclaimer, the term of this patent is extended or adjusted under 35 U.S.C. 154(b) by 687 days.

(21) Appl. No.: 10/819,359

(22) Filed: Apr. 6, 2004

(65) Prior Publication Data

US 2005/0220315 A1 Oct. 6, 2005

(51) Int. Cl.
*H04R 25/00* (2006.01)

(52) U.S. Cl. ..... 381/312; 381/23.1; 381/318

(58) Field of Classification Search ..... 381/312, 381/317, 318, 321, 323, 328, 60, 23.1
See application file for complete search history.

(56) References Cited

U.S. PATENT DOCUMENTS 6,026,288 A 2/2000 Bronner
6,134,329 A * 10/2000 Gao et al. ..... 381/60
6,330,339 B1 12/2001 Ishige et al.
2004/0022393 A1 2/2004 Jones

FOREIGN PATENT DOCUMENTS

WO 02/07480 1/2002
WO 02/13576 2/2002

* cited by examiner

*Primary Examiner*—Curtis Kuntz
*Assistant Examiner*—Tuan Duc Nguyen
(74) *Attorney, Agent, or Firm*—Pearne & Gordon LLP

(57) ABSTRACT

A hearing device is activated by operating the hearing device in an operating mode in a first phase after supplying energy to internal circuitry of the hearing device, by operating the hearing device in a reduced operating mode in a second phase and by operating the hearing device in a selectable operating mode in a third phase. Thereby, the hearing device user can examine a correct functioning of the hearing device before its insertion into the ear. In addition, the hearing device can thereafter be inserted without that a feedback signal is generated.

46 Claims, 1 Drawing Sheet

METHOD FOR ACTIVATING A HEARING DEVICE

TECHNICAL FIELD OF THE INVENTION

The present invention is related to a method to activate a hearing device.

BACKGROUND OF THE INVENTION

Hearing devices are usually activated and run in a normal operating mode after a battery has been inserted into its battery chamber. This procedure is somewhat awkward for the hearing device user because he or she has to insert the device in the ear while it is generating a loud feedback signal.

Therefore, it has been proposed to incorporate a delay circuitry into the hearing device in order to postpone the activation of the normal operating mode. Such a hearing device is disclosed in DE-195 26 175 C1.

While using the known hearing device, the user does not know whether his hearing device functions properly after having inserted a battery.

An objective of the present invention is to eliminate the above-mentioned drawback.

SUMMARY OF THE INVENTION

A hearing device is activated by operating the hearing device in an operating mode in a first phase after supplying energy to internal circuitry of the hearing device, by operating the hearing device in a reduced operating mode in a second phase, and by operating the hearing device in a selectable operating mode in a third phase.

Accordingly, several advantages of the present invention are as follows: By the method according to the present invention, comprising the steps of

- operating the hearing device in an operating mode in a first phase after supplying energy to internal circuitry of the hearing device,
- operating the hearing device in a reduced operating mode in a second phase and
- operating the hearing device in a selectable operating mode in a third phase, the hearing device user can examine a correct functioning of the hearing device before its insertion into the ear. In addition, the hearing device can thereafter be inserted without that a feedback signal is generated.

The correct functioning of the hearing device is thereby indicated by a feedback signal generated by the hearing device in the first phase. The feedback signal is used by the hearing device professional or the hearing device user, respectively, as simple function check: The hearing device is turned on and placed in the open hand. The well audible feedback signal shows that the hearing device is functioning correctly (e.g. the battery is supplying the hearing device with sufficient energy, the signal processor is working, the hearing device is amplifying the input signal, and the microphone and the receiver are not plugged up).

It is expressly pointed out that under the term "hearing device" as used in connection with the disclosure of the present invention the following must be understood:

BTE—(Behind-the-Ear) hearing devices;

ITE—(In-The-Ear) hearing devices;

CIC—(Completely-In-the-Canal) hearing devices;

Communication devices in general, as for example walkie-talkies.

In other words, the term "hearing device" is not only used in connection with devices to improve the hearing of hearing impaired patients but also, and in addition, with better hearing in general in order to improve communication.

BRIEF DESCRIPTION OF THE DRAWINGS

Exemplified embodiments of the present invention will be described in the following referring to drawings, which show.

DETAILED DESCRIPTION OF SEVERAL EMBODIMENTS OF THE INVENTION

Figure 1:
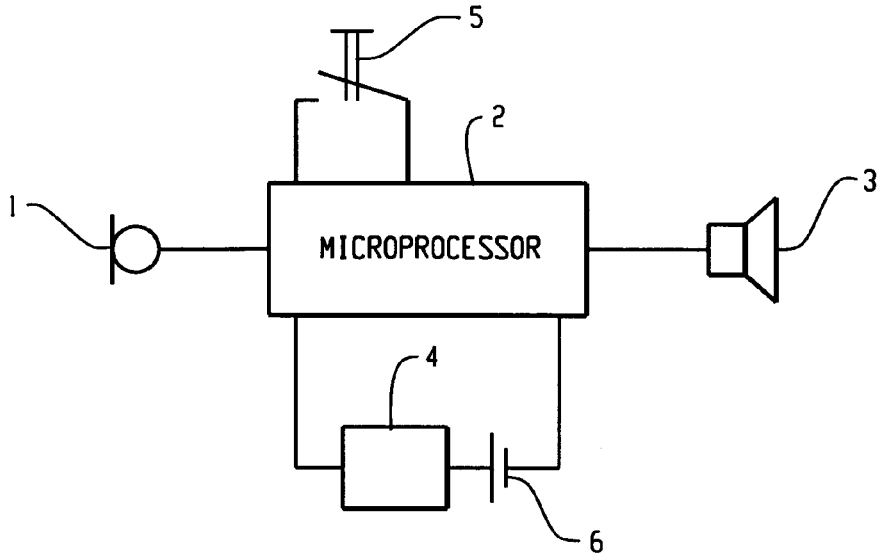
FIG. 1, schematically, a hearing device operated according to the present invention and FIG. 2 an activation course for the hearing device of FIG. 1 after switching on power supply.

In FIG. 1, a hearing device is schematically shown in a block diagram. The hearing device comprises a microphone 1, a signal processing unit 2, a receiver 3 which is basically a loudspeaker, a power detection unit 4, a battery 6 and a user input unit 5. Of course, additional components and input/output units might be present, particularly analog-to-digital and digital-to-analog converters for digital hearing devices. The signal processing unit 2 is a central unit to which the microphone 1, the battery 6 and the power detection unit 4, the receiver 3 and the user input unit 5 are connected. In practice, the signal processing unit 2 might be realized using several components integrated on different circuits. On the other hand, the signal processing unit 2 might also be integrated on a single chip.

The power detection unit 4, although shown in FIG. 1, is not mandatory. It rather illustrates an embodiment in which a dedicated unit is provided to detect insertion of a battery 6 and/or the status of the battery 6. The information gathered in the power detection unit 4 is transmitted to the signal processing unit 2.

Figure 2:
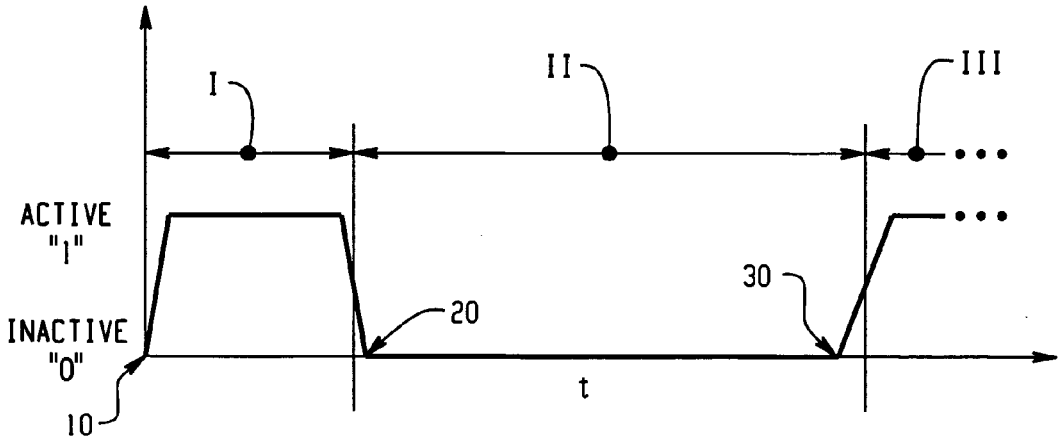

FIG. 2 shows a course representing the activation states of the hearing device as a function of time. The time axis is divided up into three phases I, II and III which are passed through in sequence after power supply is switched on, e.g. the battery is inserted into the battery chamber of the hearing device or by pressing a power-on button, respectively. The actual point in time of battery insertion is indicated by 10, i.e. the origin of the graph depicted in FIG. 2.

According to the present invention, the hearing device will be in the first phase I after the battery is inserted. As it is shown in FIG. 2, the hearing device is in an active state after the hearing device has been initialized and will therefore process the input signal coming from the microphone 1 in the signal processing unit 2 to generate the output signal fed to the receiver 3. In this first phase I, the user will normally hold the hearing device in his hands—he just inserted the battery into the battery chamber of the hearing device. Accordingly, the hearing device will generate a feedback signal—usually a loud sound which can very well be heard. This feedback signal is an actual confirmation that indicates the correct functioning of the hearing device to the user. The hearing device is now ready to be inserted into the ear.

The insertion of the hearing device into the ear is not recommended during the first phase I since the feedback signal is usually very loud and would discomfort the hearing device user. Therefore, the second phase II must be awaited during which—as can be seen from FIG. 2—the hearing device is "inactive", i.e. the processing line is interrupted or at least damped somewhere in-between the microphone 1 and the receiver 3 in order that no feedback loop through the hearing device is formed, whereby the interruption may be implemented by reducing the gain applied in the signal processing unit of the hearing device. In the second phase II which is usually longer than the first phase I, the hearing device can be inserted into the ear, whereby the hearing device user can concentrate himself on the insertion process without being disturbed by a feedback signal. The second phase II is therefore also called "reduced operating mode", "reduced gain operating mode" or "mute operating mode".

At the end of the second phase II, the hearing device is ready to be operated in a normal fashion, i.e. in a selectable operating mode, the term "selectable" referring to the possibility of selecting a specific hearing program out of several available hearing programs, whereby in one embodiment, the hearing device user makes the selection and, in another embodiment, the signal processing unit 2 or a similar unit makes the selection automatically. In a still further embodiment of the present invention, the selection of a hearing program is not available.

Having said the above, the present invention opens-up a variety of further embodiments which will be explained in the following:

In a first embodiment of the present invention, the lengths of the first and second phases I and II are set to a preset value, the beginning of the first phase I being defined by the battery insertion. While the first phase I has, for example, a length of 2 to 5 seconds, the second phase II has, for example, a length of 15 to 60 seconds.

In a second embodiment of the present invention, the length of the first phase I is user dependent in that the hearing device user presses a button, e.g. the user input unit 5 (FIG. 1), as soon as he is satisfied with the function check, i.e. as soon as the hearing device user is ready to insert the hearing device into the ear. By pressing the switch of the user input unit 5 (also called "event-driven"), the first phase I is terminated immediately, and the second phase II begins which can be of a preset length.

In a third embodiment of the present invention, no user interaction as described-above is used to terminate the first phase I. Instead, the first phase I is terminated automatically as soon as a feedback signal of, for example, 2 seconds length has been detected. On the assumption that the hearing device user has noticed the normal functioning of the hearing device, the second phase II can begin.

In a fourth embodiment of the present invention, the length of the second phase II is controlled by estimating the feedback transfer function around the hearing device. Therewith, the end of the second phase II is predicted. In this embodiment of the present invention, a change of the feedback transfer function is used in order to determine the point in time at which the hearing device is completely inserted into the ear. The detection of such a state, i.e. the differentiation of an inserted and a not yet inserted hearing device, can be accomplished by noting that the gain of the feedback transfer function is higher if the hearing device is not inserted, compared to the situation were the hearing device is not inserted. Therefore, the assumption can be reached that the hearing device is inserted into the ear and that the second phase II can be terminated. This embodiment allows the reduction of the length of the second phase II and the assimilation of the hearing device to the needs of the hearing device user faster.

In an improved embodiment of the fourth embodiment of the present invention, the estimation of the feedback transfer function can be used to get an indication whether the hearing device is correctly inserted into the ear or whether an adjustment, i.e. a repositioning, must be carried out. In this connection, an announcement can be generated in the signal processing unit 2 and fed into the ear of the hearing device user via the receiver 3 to inform the hearing device user.

In another embodiment of the present invention, the second phase II would include a gain reduction in the hearing device so that no feedback can occur. In other words, a feedback is suppressed by reducing a closed-loop gain through the hearing device below a critical gain level. This critical gain level is the gain at which just no feedback occurs.

In a still further embodiment of the present invention, an artificial beep signal will be generated to indicate that the hearing device is in the second phase II, in addition to one of the above-described methods implemented in the second phase II. Similar beep signals may be used to indicate that the hearing device is in the first phase I or in the third phase III, respectively. The last-mentioned beep signal may also indicate that the hearing device is fully operational and that the hearing device has been successfully configured, for example that the hearing device is now ready to operate in the first hearing program. In this connection, it is also proposed in a still further embodiment of the present invention to generate a beep signal or a number of beep signals which are in direct relationship to the selected hearing program.

It is expressly pointed out that the different embodiments of the present invention, as described above, can be arbitrarily combined in the sense that the different conventions regarding the lengths for the first and the second phases I and II can be used in any combination.

As can be seen from FIG. 2, the activation level is identical in the first phase I and the third phase III. This is not absolutely necessary. In fact, there is a higher variety of possible hearing programs selectable in the third phase III than there are in the first phase I. Therefore, it is most likely that the gain settings in the first phase I are in particular different from the gain settings in the third phase III and/or the number and type of additional features (such as feedback cancelling, noise cancelling, beam forming and others) may vary. In one embodiment of the present invention, the "activation" level is preset to a "standard activation" level with little discriminating power in the first phase I while a high number of possible "activation" levels are possible with sophisticated discriminating power.

In a further embodiment of the present invention, the length of the second phase II is reduced to zero, after the device has detected that it has already been inserted into the ear.

In a further embodiment of the present invention, the lengths of the first and second phases I and II are dependent on an internal state of the hearing device. The internal state of the hearing device may, for example, contain information related to answers to one or several of the following questions:

Is the hearing device already inserted into the ear?

Was the hearing device inserted before it has been turned off?

Was the hearing device turned off by the user?

Was the hearing device turned off by the end-of-life of the battery?

This information can be included in a matrix containing a set of rules which configure the timing of the first phase I and the second phase II.

A possible set of rules may look like this:

The second phase II is short, e.g. between zero and two seconds, if the device is restarted from the reduced operating mode or the hearing device has been turned off by a remote control.

On the other hand, the second phase II is long, e.g. between eight and twenty seconds, if the hearing device has been turned off because the battery was empty.

For ITE hearing devices, the temperature of an integrated circuit in the hearing device, for example the integrated circuit containing the signal processing unit, may also be taken into account while defining the matrix:

The first phase I and second phase II are configured short, e.g. between zero and two seconds, if the temperature of the device is higher then 30 degree Celsius and the last power down was not due to an empty battery.

The invention claimed is:

1. A method to activate a hearing device, comprising the steps of operating the hearing device in an operating mode in a first phase after supplying energy to internal circuitry of the hearing device, operating the hearing device in a reduced operating mode in a second phase, operating the hearing device in a selectable operating mode in a third phase, estimating a feedback transfer function of the hearing device, and triggering a transition from the first to the second phase as a result of the estimated feedback transfer function.

2. The method of claim 1, further comprising the step of generating a signal indicating the currently active phase.

3. The method of claim 1, further comprising the step of generating a signal indicating a configuration in the third phase.

4. The method of claim 1, wherein the second phase has a fixed length.

5. The method of claim 1, further comprising the step of terminating the first phase as soon as a feedback signal has been detected during a preset length.

6. The method of claim 1, further comprising the step of triggering a transition from the second the third phase as a result of the estimated feedback transfer function.

7. The method of claim 1, further comprising the step of triggering a beginning of the first phase by inserting a battery into the hearing device.

8. A method to activate a hearing device, the method comprising the steps of operating the hearing device in an operating mode in a first phase after supplying energy to internal circuitry of the hearing device, operating the hearing device in a reduced operating mode in a second phase, operating the hearing device in a selectable operating mode in a third phase, and terminating the first phase as soon as a feedback signal has been detected during a preset length.

9. The method of claim 8, further comprising the step of generating a signal indicating the currently active phase.

10. The method of claim 8, further comprising the step of generating a signal indicating a configuration in the third phase.

11. The method of claim 8, wherein the second phase has a fixed length.

12. The method of claim 8, further comprising the steps of:

estimating a feedback transfer function of the hearing device, and triggering a transition from the second to the third phase as a result of the estimated feedback transfer function.

13. The method of claim 8, further comprising the step of adjusting a length of the second phase as a function of an inner state of the hearing device.

14. The method of claim 8, further comprising the step of triggering the beginning of the first phase by inserting a battery into the hearing device.

15. A method to activate a hearing device, the method comprising the steps of operating the hearing device in an operating mode in a first phase after supplying energy to internal circuitry of the hearing device, operating the hearing device in a reduced operating mode in a second phase, operating the hearing device in a selectable operating mode in a third phase, estimating a feedback transfer function of the hearing device, and triggering a transition from the second to the third phase as a result of the estimated feedback transfer function.

16. The method of claim 15, wherein the first phase has a fixed length.

17. The method of claim 15, further comprising the step of generating a signal indicating a currently active phase.

18. The method of claim 15, further comprising the step of generating a signal indicating a configuration in the third phase.

19. The method of claim 15, wherein a transition from the first to the second phase is triggered by a user interaction.

20. The method of claim 15, further comprising the step of triggering a transition from the first to the second phase as a result of the estimated feedback transfer function.

21. The method of claim 15, further comprising the step of terminating the first phase as soon as a feedback signal has been detected during a preset length.

22. The method of claim 15, further comprising the step of adjusting a length of the first phase as a function of an inner state of the hearing device.

23. The method of claim 15, further comprising the step of triggering a beginning of the first phase by inserting a battery into the hearing device.

24. A hearing device comprising a microphone, a signal processing unit, and a receiver, the microphone being operatively connected to the receiver via the signal processing unit, the hearing device further comprises:

means for operating the hearing device in an operating mode in a first phase after supplying energy to internal circuitry of the hearing device, means for operating the hearing device in a reduced operating mode in a second phase, means for operating the hearing device in a selectable operating mode in a third phase, means for estimating a feedback transfer function of the hearing device, and means for triggering a transition from the first to the second phase as a result of the estimated feedback transfer function.

25. The hearing device of claim 24, further comprising means for generating a signal indicating the currently active phase.

26. The hearing device of claim 24, further comprising means for generating a signal indicating a configuration in the third phase.

27. The hearing device of claim 24, wherein the second phase has a fixed length.

28. The hearing device of claim 24, further comprising means for terminating the first phase as soon as a feedback signal has been detected during a preset length.

29. The hearing device of claim 24, further comprising means for triggering a transition from the second to the third phase as a result of the estimated feedback transfer function.

30. The hearing device of claim 24, further comprising means for triggering the beginning of the first phase by inserting a battery into the hearing device.

31. A hearing device comprising a microphone, a signal processing unit, and a receiver, the microphone being operatively connected to the receiver via the signal processing unit, the hearing device further comprises:

means for operating the hearing device in an operating mode in a first phase after supplying energy to internal circuitry of the hearing device, means for operating the hearing device in a reduced operating mode in a second phase, means for operating the hearing device in a selectable operating mode in a third phase, and means for terminating the first phase as soon as a feedback signal has been detected during a preset length.

32. The hearing device of claim 31, further comprising means for generating a signal indicating the currently active phase.

33. The hearing device of claim 31, further comprising means for generating a signal indicating a configuration in the third phase.

34. The hearing device of claim 31, wherein the second phase has a fixed length.

35. The hearing device of claim 31, further comprising:

means for estimating a feedback transfer function of the hearing device, and means for triggering a transition from the second to the third phase as a result of the estimated feedback transfer function.

36. The hearing device of claim 31, further comprising means for adjusting a length of the second phase as a function of an inner state of the hearing device.

37. The hearing device of claim 31, further comprising means for triggering a beginning of the first phase by inserting a battery into the hearing device.

38. A hearing device comprising a microphone, a signal processing unit, and a receiver, the microphone being operatively connected to the receiver via the signal processing unit, the hearing device further comprises:

means for operating the hearing device in an operating mode in a first phase after supplying energy to internal circuitry of the hearing device, means for operating the hearing device in a reduced operating mode in a second phase, means for operating the hearing device in a selectable operating mode in a third phase, and means for estimating a feedback transfer function of the hearing device, and means for triggering a transition from the second to the third phase as a result of the estimated feedback transfer function.

39. The hearing device of claim 38, further comprising means for generating a signal indicating a currently active phase.

40. The hearing device of claim 38, further comprising means for generating a signal indicating a configuration in the third phase.

41. The hearing device of claim 38, wherein the first phase has a fixed length.

42. The hearing device of claim 38, wherein a transition from the first to the second phase is capable of being triggered by a user interaction.

43. The hearing device of claim 38, further comprising means for triggering a transition from the first to the second phase as a result of the estimated feedback transfer function.

44. The hearing device of claim 38, further comprising means for terminating the first phase as soon as a feedback signal has been detected during a preset length.

45. The hearing device of claim 38, further comprising means for adjusting a length of the first phase as a function of an inner state of the hearing device.

46. The hearing device of claim 38, further comprising means for triggering a beginning of the first phase by inserting a battery into the hearing device.

* * * * *

UNITED STATES PATENT AND TRADEMARK OFFICE

CERTIFICATE OF CORRECTION

PATENT NO. : 7,308,107 B2
APPLICATION NO. : 10/819359
DATED : December 11, 2007
INVENTOR(S) : Stefan Daniel Menzl and Ivo Hasler It is certified that error appears in the above-identified patent and that said Letters Patent is hereby corrected as shown below:

In the claims:

Column 6, Line 29: Please delete the word "first"; Replace with the word --second--

Signed and Sealed this

Thirteenth Day of May, 2008

JON W. DUDAS
*Director of the United States Patent and Trademark Office*